United States Patent [19]

Zucker

[11] Patent Number: 5,057,116

[45] Date of Patent: Oct. 15, 1991

[54] DEPILATORY DEVICE

[75] Inventor: Shlomo Zucker, Yavneh, Israel

[73] Assignee: Crestmoore Ltd., Hong Kong, Isle of Man

[21] Appl. No.: 578,355

[22] Filed: Sep. 6, 1990

[30] Foreign Application Priority Data

Sep. 14, 1989 [IL] Israel ..... 91643
Feb. 4, 1990 [IL] Israel ..... 93266

[51] Int. Cl.[5] ..... A61K 7/00
[52] U.S. Cl. ..... 606/133; 606/131; 606/36; 606/43
[58] Field of Search ..... 606/36, 43, 131, 133, 606/180, 181, 182, 183; 30/34.2

[56] References Cited

U.S. PATENT DOCUMENTS 2,497,719 2/1950 Fichter ..... 606/133
2,586,855 2/1952 Orner ..... 606/133

*Primary Examiner*—Stephen C. Pellegrino
*Assistant Examiner*—Glenn K. Dawson
*Attorney, Agent, or Firm*—Charles E. Baxley

[57] ABSTRACT

A depilatory cartridge, to be mounted on a casing, includes at least one rotating drum and a plurality of jaws associated with an cammed toward each drum during part of the rotating cycle of the drum. The jaws are pushed apart from the drum in the remaining part of the rotating cycle, so tht when the cartridge is placed in touch with body hair, the hair is caught in gaps formed between the jaws and the drum and as the gap closes during rotation of the drum, the hair is pulled out.

11 Claims, 3 Drawing Sheets

DEPILATORY DEVICE

BACKGROUND OF THE INVENTION

This invention relates to a depilatory device, the device having a depilatory cartridge head that is particularly useful to pluck short body hair.

Several hair-plucking devices are described in the prior art. They are in the form of springs, rubber bands, slit rubber rollers, rotating cams, rotating plates, or the like. All the prior art devices are concerned with all types of body hair removal, and are not designed particularly for short hair removal. The need for a special device to remove short hair arises particularly from women who do not want to wait more than one or two days after hair appearance on their legs or other exposed parts of their bodies before depilation. Most, if not all prior art devices, are limited as to the length of hair they can depilate. Hair shorter than 3 mm., or in particular, of length from 1 to 2 mm., is almost not removable.

SUMMARY OF THE INVENTION

It is the purpose of this invention to provide a depilation device, in particular a cartridge head, which is mountable on or in a manually grippable casing, containing an electric motor, activated by a switch, which cartridge head will remove short body hair and in particular hair shorter than 3 mm.

The depilatory cartridge head herein provided comprises a plurality of rotatable drums. A plurality of jaws are associated with each drum, and are cammed toward their associated drum during part of its cycle. The jaws then recede from the drum in the remaining part of its cycle, so that when the cartridge head is placed in touch with body hair, the hair is caught in the gaps formed between the jaws and the drum, and as the gap closes during the rotation of the drum, the hair is pulled out.

In a first preferred embodiment, each rotatable drum is in the form of a central rotatable circular pin, mounted on a base plate, the jaws are in form of a plurality of circumferentiallyspaced arms hinged to the base plate, and the jaws are pushed inwardly toward the rotatable pin, by a spring spaced outwardly from the outer circumference of the pin to intersect a portion of the moving path of the jaws. When the jaws move away from the spring the centrifugal force exerted on the jaws moves them away from the central pin, thus opening a gap therebetween, so that when the cartridge is placed in touch with body hair, the hair enters the gap between one of the jaws and the central pin and as the gap is closed by the spring the hair is caught and pulled out.

In a second preferred embodiment, the rotating drum is in the form of a plurality of circular sections rotating in an elliptical cam bushing, and each drum section has a radial hole. A plurality of central cylinder section plates, acting as jaws, each having a tooth extend through the corresponding hole of said the drum sections. A plurality of springs are mounted on pins that extend along both sides of the jaws push the jaws apart toward the drum sections, so that when the drum sections rotate and move from the wider elliptical part of the cam bushing into the narrower elliptical part of the cam bushing, the teeth extending through the holes in the drum sections are pressed inwardly, thus pushing the jaws toward each other and opening a gap between the jaws and the drum sections. When at that position, the springs are pressed inward, and as the drum sections enter again the wider path of the elliptical cam bushing, the jaws are pushed apart outwards against the drum section walls by action of the springs, and the centrifugal force exerted on the jaws by the rotational movement, and the teeth can again extend through the holes in the drum section. When the cartridge head is put in touch with the body hair, the hair enters the gap formed between the jaws and the drum sections, and as the gap closes, the hair is caught and pulled out.

In a third preferred embodiment, a depilatory cartridge head comprises a rotatable drum having a central boss. A pair of jaws are connected to the boss by a pair of flexible arms and the boss has a longitudinal cam with curved edges to fit onto the mouth of the jaws. A pair of leaf springs are mounted on opposite sides of the inner circumferential wall of a groove so that when the drum rotates, the jaws engage the leaf springs and are thereby pushed inward, thus closing a gap between the jaws and the curved edges, and as the jaws leave the springs, the gap again opens. Thus, when the drum while rotating is put in touch with body hair, the hair enters the gap, and when the gap closes, as the jaws engage the leaf springs, the hair is caught and pulled out.

In any disclosed preferred embodiment the drum is rotated at a speed of 2000 to 5000 rpm, preferably 4000 rpm for the first and second embodiments and 2000 rpm for the third embodiment, and the height of the drum and jaws is about 3 mm. above the base on which they are mounted.

It is preferred that each head includes three equallyspaced rotatable drum units.

DESCRIPTION OF THE INVENTION

Figure 1:
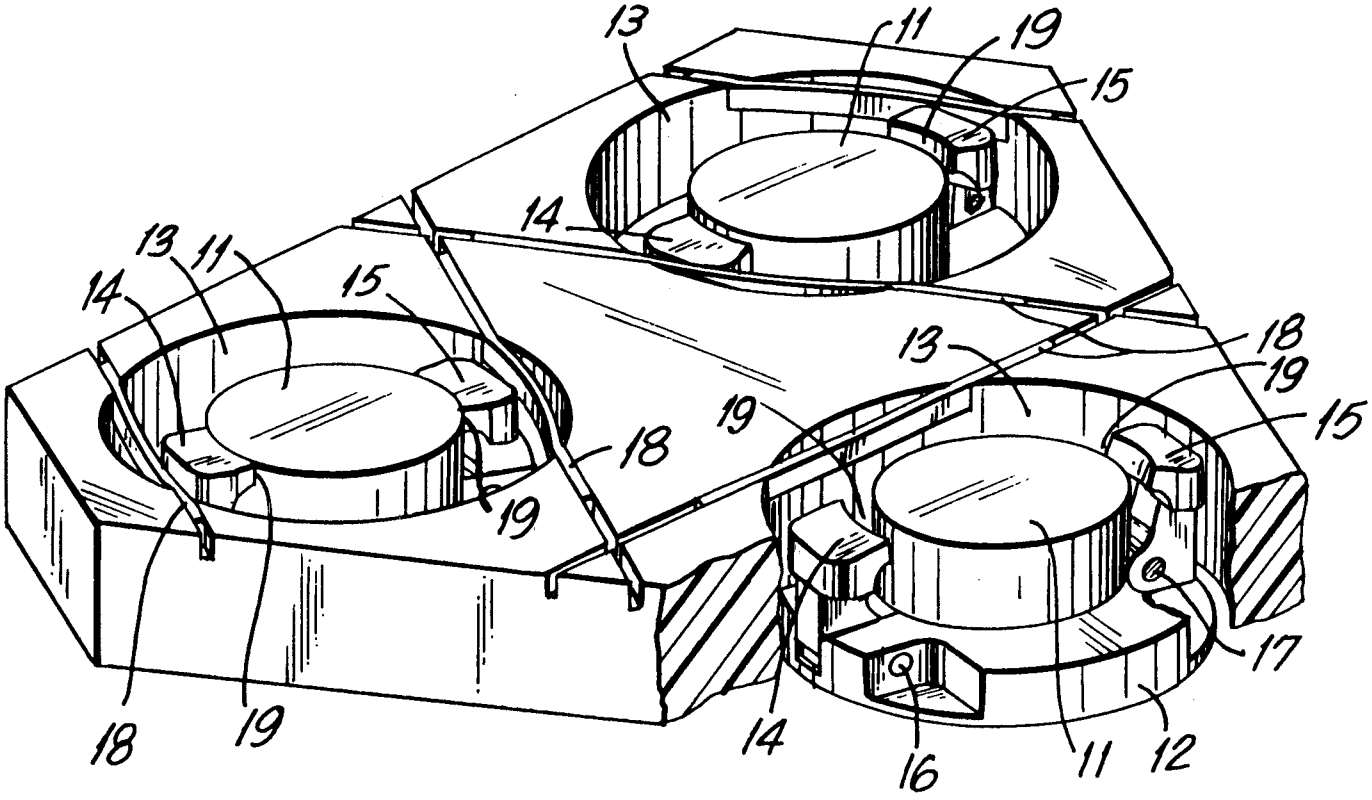
FIG. 1 is an isometric drawing illustrating the first embodiment.
Figure 2:
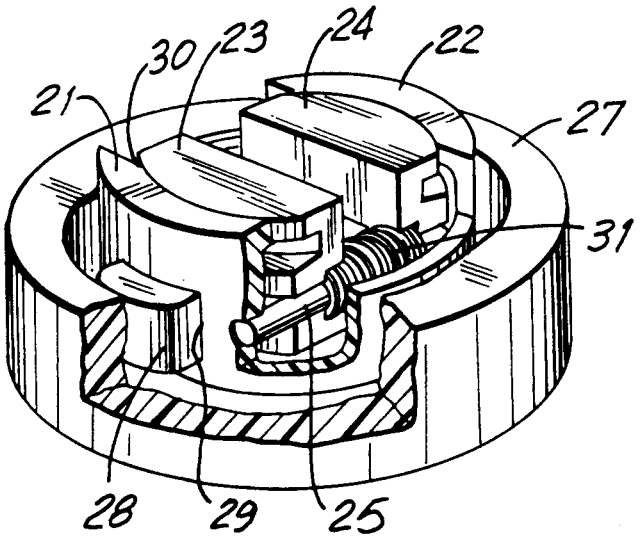
FIGS. 2 and 3 are two isometric drawings illustrating the open and closed positions of the second embodiment.
Figure 4:
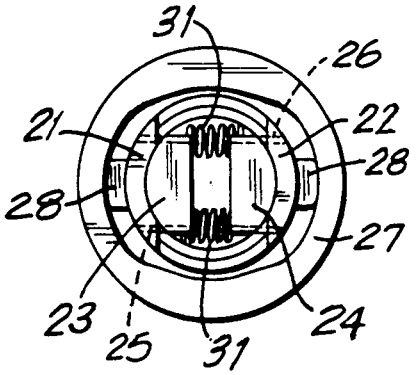
FIGS. 4 and 5 are top views of the second embodiment in the two positions illustrated in FIGS. 2 and 3, respectively.
Figure 3:
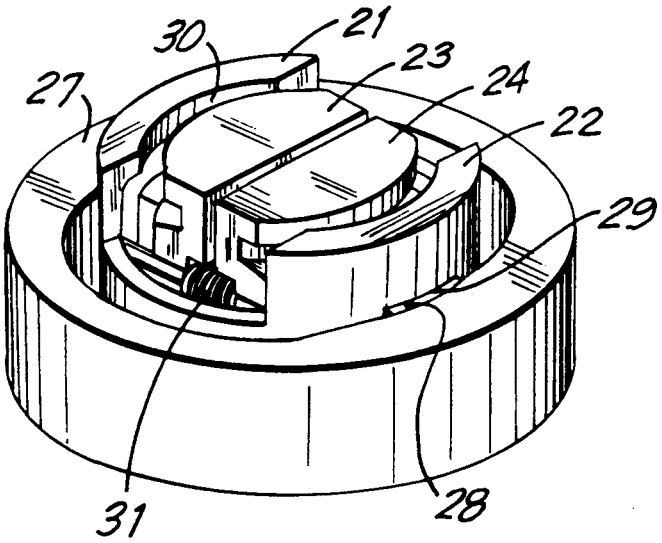
Figure 5:
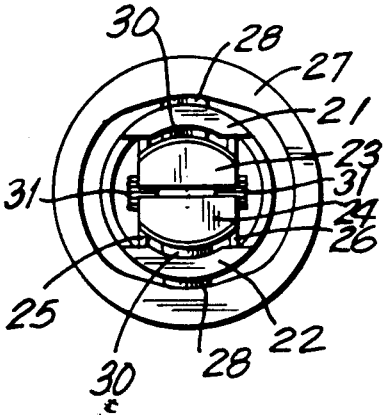

FIG. 1 illustrates an embodiment wherein three depilation cartridge heads are shown, all mounted on one cartridge mountable on motor pins (not shown). The three heads are shown in three different positions.

The central rotatable drum 11, mounted on a plate 12, rotates inside a groove 13, extending out towards the skin by about 3 mm. Two jaws 14, 15 are mounted on the same plate 12, hinged to the plate by the hinges 16, 17. The upper sections of jaws 14, 15 are circular, so that they can close on to the circumference of the Two generally parallel leaf springs 18 are associated with each drum 11 and have central portions spaced between drum 11 and the wall of groove 13. sides of the groove 13.

When drum 11 rotates and the jaws 14, 15 reach the position where they meet the associated springs 18 extending along a section of the groove 13, springs 18 push the jaws 14, 15 inwards to clamp with the outer surface of the rotating drum 11. The gap 19 between jaws 14, 15 and drum 11 is closed and hair thus caught in gap 19 is clamped and pulled out as the drum 11 rotates. When the jaws 14, 15 move away from the spring 18, the centrifugal force pulls the jaws 14, 15 away from the drum 11, and the gap 19 between the jaws 14, 15 and the drum 11 opens up to allow body hair to enter.

FIGS. 2, 3, 4 and 5 illustrate the different positions of a second cartridge head embodiment, illustrating one out of three depilating heads to be mounted on and became parts of the cartridge.

The rotatable drum sections 21, 22, have radial holes 29 in them through which teeth 28 of the central half circular jaws 23, 24 project outwardly. The drum rotates inside an elliptical cam bushing 27, extending about 3 mm. above the bushing wall towards the skin. Springs 31 are mounted on pins 25, 26 on both sides of the half circular jaws 23, 24 and press jaws 23, 24 apart toward the inner walls of drum sections 21, 22. When the drum sections 21, 22 are in the wider part of the elliptical shape of cam bushing 27, teeth 28 project outwardly from the holes 29, and springs 31, 32 and the centrifugal force press jaws 23, 24 towards the inner walls of the drum sections 21, 22, and the gap 30 is closed. When the drum sections 21, 22 move to the narrow part of the ellipse of the cam bushing 27, as in FIG. 5, the teeth 28 are pressed inwards by the cam bushing wall 27. Thus the jaws 23, 24 move inwards towards each other, pressing in the springs 25, 26 and opening the gap 30 between the jaws 23, 24 and the drum sections 21, 22. The body hair in contact with the device enters the gap 30, and as the gap 30 closes again, the hair is caught and pulled out.

Three such sections are mounted onto the device motor (not seen).

Figure 6:
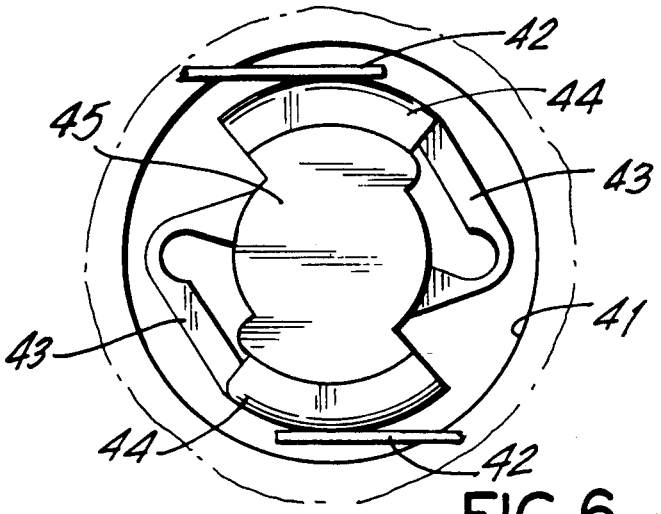
FIG. 6 illustrates a top view of the third embodiment shown as a single drum cartridge head, when the jaws close the gap and are pushed towards the cam head.

The third preferred embodiment of the invention is shown in FIGS. 6–9. FIG. 6 is a top view showing the rotating drum in the position where the jaws 44 are pushed towards the center by the springs 42, to engage the cam head 45. The groove 41 is shown as the outer circumference. The cam head 45 is integral with the drum shaft or boss 46. The jaws 44 are connected to the drum shaft 46 by the flexible arms 43. The leaf springs 42 are mounted on diametrically opposite sides of the groove 41, and when the jaws 44 engage them they are pushed towards the cam head 45, as seen.

Figure 7:
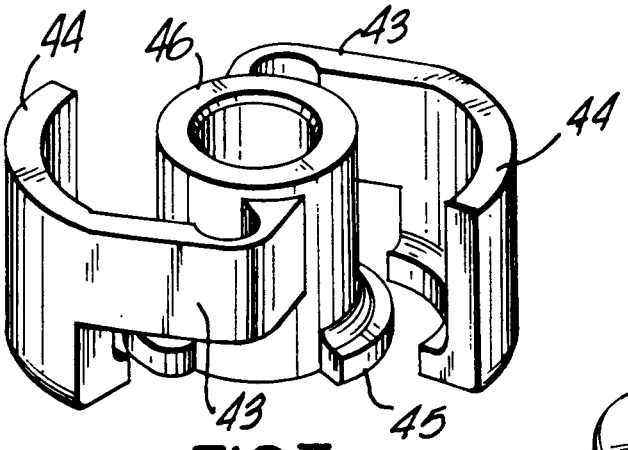
FIGS. 7 and 8 are bottom and top perspective views, respectively, of the third embodiment rotating drum in the open gap position.
Figure 8:
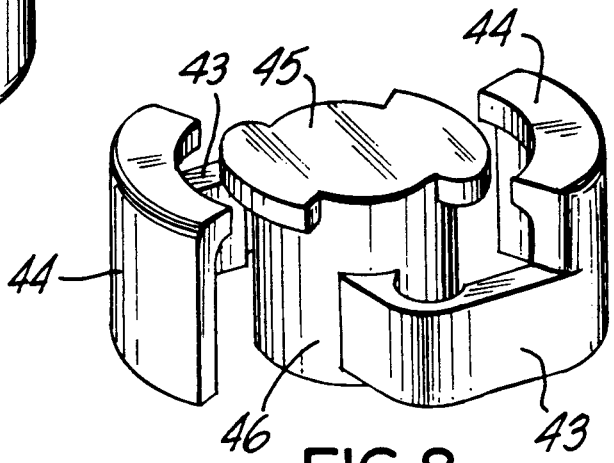

FIG. 7 shows the bottom view and FIG. 8 shows the top view in three dimensions of the rotating drum construction. The jaws 44 are connected to the drum shaft 46 by the flexible arms 43. These two views represent the open status of the drum arrangement.

Figure 9:
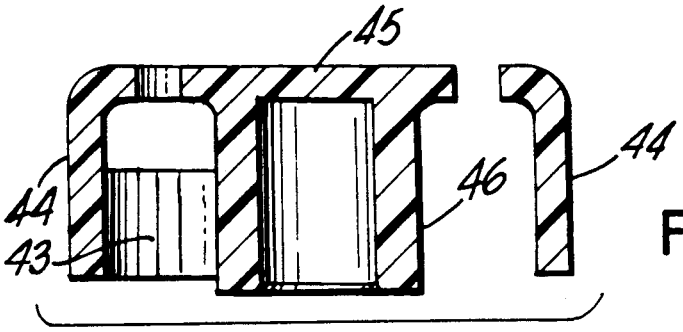
FIG. 9 is a cross-sectional view of the drum of the third embodiment.

FIG. 9 is a cross-sectional view of the drum showing the drum shaft 46, the cam head 45, and the two jaws 44.

The drum rotates at a speed of about 2000 rpm and the leaf spring pressure is about 100 gm.

In the preferred embodiment the springs are made of metal, and the drum parts, the jaws, cam head and shaft are made of plastic, preferably acetal, or polypropylene.

While the invention is described in reference to the attached drawings, it should be appreciated that other variants should be regarded as part of the invention.

What is claimed is:

1. A depilatory cartridge including at least one head comprising a base plate, a drum carried by and rotatable with said base plate and a plurality of jaws mounted on said base plate being rotatable with and cammed toward said drum during part of the rotating cycle of said drum and then pushed apart from said drum in the remaining part of the rotating cycle, so that when said drum while rotating is placed in touch with body hair, the hair is caught in gaps formed between said jaws and said drum, and as said gap closes during the rotation of said drum, said hair is pulled out.

2. A cartridge as in claim 1 wherein said rotatable drum is in form of a central rotatable pin mounted on said base plate; and said jaws are in form of arms hinged to said base plate, and said jaws are pushed inwards towards said rotatable pin by a spring in the moving path of said jaws, and when said jaws move away from said spring, the centrifugal force exerted on said jaws moves them away from said central pin thus opening a gap, so that when said cartridge head is placed in touch with body hair, the hair enters said gap between said jaws and said central pin and as the gap closes, the hair is caught and pulled out.

3. A cartridge in claim 1 wherein said rotating drum includes a plurality of drum sections rotating in an elliptical cam bushing, each said drum section having a hole therethrough and said jaws comprising a plurality of central cylinder section plates, each having a tooth extending through the corresponding hole of a said drum section, and a plurality of springs mounted on pins extending along both sides of said jaws pushing them apart towards said drum section, so that when said drum sections rotate and move from the wider part of the elliptical path, each said tooth is pressed inwardly, thus pushing said jaws towards each other and opening a gap between said jaws and said drum sections and compressing said springs, and as said drum sections enter again the wider part of the elliptical path, said jaws are pushed apart outwardly against said drum section walls by action of said springs, and the centrifugal force exerted on said jaws by the rotational movement, and said teeth again extend through said holes in said drum sections, and when said cartridge head is put in touch with said body hair, said hair enters the gap formed between said jaws and said drum sections and as said gap closes, when said jaws move towards said drum sections said hair is caught and pulled out.

4. A cartridge as in claim 1 wherein said cartridge comprises a plurality of said drums.

5. A cartridge as in claim 1 wherein said drum and said jaws extend about 3 mm. above said base plate.

6. A cartridge as in claim 1 wherein the number of said heads is three.

7. A depilatory cartridge including at least one head comprising a rotatable drum having a central boss, a pair of jaws connected to said boss by a pair of flexible arms, said boss provided with a longitudinal cam having curved edges to fit onto the mouth of said jaws, and a pair of leaf springs mounted on opposite sides of an inner cylindrical wall surrounding said drum so that when said drum rotates, said jaws engage said leaf springs and are thereby pushed inward, thus closing a gap between said jaws and said curved edges, and as said jaws leave said springs, said gap again opens so that when said drum while rotating is put in touch with body hair, the hair enters said gap, and when said gap closes, as said jaws engage said leaf springs, said hair is caught and pulled out.

8. A cartridge head as in claim 7 wherein each said leaf spring is made of metal with a force of about 100 gr.

9. A cartridge head as in claim 7 wherein said drum is made of plastic.

10. A cartridge head as in claim 9 wherein said plastic is selected from acetal and polypropylene.

11. A cartridge head as in claim 7 comprising three said heads, to be used particularly to depilate short hair below 3 mm. in length, after one or two weeks of growth.

* * * * *